US010436514B2

(12) United States Patent
Higashiiue et al.

(10) Patent No.: US 10,436,514 B2
(45) Date of Patent: Oct. 8, 2019

(54) HEAT EXCHANGER AND REFRIGERATION CYCLE APPARATUS

(71) Applicant: Mitsubishi Electric Corporation, Tokyo (JP)

(72) Inventors: Shinya Higashiiue, Tokyo (JP); Akira Ishibashi, Tokyo (JP); Daisuke Ito, Tokyo (JP); Yuki Ugajin, Tokyo (JP); Shin Nakamura, Tokyo (JP); Ryota Akaiwa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/767,918

(22) PCT Filed: Dec. 21, 2015

(86) PCT No.: PCT/JP2015/085619
§ 371 (c)(1),
(2) Date: Apr. 12, 2018

(87) PCT Pub. No.: WO2017/109823
PCT Pub. Date: Jun. 29, 2017

(65) Prior Publication Data

US 2018/0299203 A1 Oct. 18, 2018

(51) Int. Cl.
*F28D 1/053* (2006.01)
*F28D 1/04* (2006.01)
(Continued)

(52) U.S. Cl.
CPC ..... *F28D 1/0435* (2013.01); *F28D 1/05391* (2013.01); *F28F 1/32* (2013.01);
(Continued)

(58) Field of Classification Search
USPC ..... 165/174, 176
See application file for complete search history.

(56) References Cited

U.S. PATENT DOCUMENTS 2,419,575 A * 4/1947 Byram ..... B60H 1/20 165/158
3,173,482 A * 3/1965 Allender ..... F28F 9/0217 165/174
(Continued)

FOREIGN PATENT DOCUMENTS

EP 3 051 244 A1 8/2016
JP S55-131479 U 3/1979
(Continued)

OTHER PUBLICATIONS

International Search Report dated Mar. 8, 2016 issued in corresponding international patent application No. PCT/JP2015/085619 (and English translation).
(Continued)

*Primary Examiner* — Allen J Flanigan
(74) *Attorney, Agent, or Firm* — Posz Law Group, PLC

(57) ABSTRACT

Provided is a heat exchanger, including: a first heat exchange unit, which includes a first flat tube; a second heat exchange unit, which is arranged so as to be opposed to the first heat exchange unit, and includes a second flat tube; and a tank, which connects the first heat exchange unit and the second heat exchange unit to each other. The tank has an upper wall and a lower wall defining an upper end and lower end of a tank space formed in the tank, respectively. One end of the first flat tube and one end of the second flat tube are connected to the tank space. When a height from the lower wall to the upper wall is defined as X, and a height from the lower wall to the one end of the first flat tube is defined as Y1, a relation between X and Y1 satisfies Y1<(½)X.

4 Claims, 7 Drawing Sheets

(51) Int. Cl.
*F28F 9/02* (2006.01)
*F28F 19/00* (2006.01)
*F28F 1/32* (2006.01)

(52) U.S. Cl.
CPC ..... *F28F 9/0202* (2013.01); *F28F 9/0265* (2013.01); *F28F 19/002* (2013.01); *F28F 2265/18* (2013.01)

(56) References Cited

U.S. PATENT DOCUMENTS 4,168,742 A * 9/1979 Kluppel ..... F28B 1/06 165/114
5,479,985 A * 1/1996 Yamamoto ..... F28D 1/05391 165/153
6,827,139 B2 * 12/2004 Kawakubo ..... F28D 1/0476 165/173
8,776,873 B2 * 7/2014 Mross ..... F28D 1/05391 165/176
9,151,540 B2 * 10/2015 Matter, III ..... B21C 37/151
2004/0159121 A1 * 8/2004 Horiuchi et al. ..... F25B 39/02 62/526
2011/0005271 A1 * 1/2011 Seto ..... B60H 1/00071 62/515
2013/0306285 A1 * 11/2013 Jindou ..... F25B 39/00 165/173
2015/0083377 A1 3/2015 Jindou et al.
2017/0343289 A1 11/2017 Jindou et al.
2017/0343290 A1 11/2017 Jindou et al.

FOREIGN PATENT DOCUMENTS

JP 04288490 A * 10/1992 ..... F28F 9/0212
JP 2013-231535 A 11/2013
JP 2015-055413 A 3/2015
WO 2015/046275 A1 4/2015

OTHER PUBLICATIONS

Office action dated Mar. 19, 2019 issued in corresponding JP patent application No. 2017-557526 (and English translation thereof).
Office Action dated Jun. 4, 2019 issued in corresponding CN patent application No. 201580085442.3 (and English ranslation thereof).

* cited by examiner

HEAT EXCHANGER AND REFRIGERATION CYCLE APPARATUS

CROSS REFERENCE TO RELATED APPLICATION

This application is a U.S. national stage application of PCT/JP2015/085619 filed on Dec. 21, 2015, the contents of which are incorporated herein by reference.

TECHNICAL FIELD

The present invention relates to a heat exchanger including a plurality of heat exchange units, and to a refrigeration cycle apparatus.

BACKGROUND ART

In Patent Literature 1, there is described a heat exchanger including a windward tube row, a leeward tube row, and fins. The windward tube row and the leeward tube row are each constructed by a plurality of flat tubes arranged in parallel, and are arrayed in a flow direction of air. The fins are joined to the flat tubes. The heat exchanger includes a connection unit including n number of communication paths for allowing end portions of n number (n is an integer of 2 or more) of flat tubes constructing the windward tube row and end portions of n number of flat tubes constructing the leeward tube row to communicate with each other, respectively. The connection unit includes a second windward header collection pipe, a second leeward header collection pipe, and n number of coupling pipes. An internal space of the second windward header collection pipe is partitioned by a large number of partition plates into n number of first coupling spaces that communicate with the end portions of the n number of flat tubes constructing the windward tube row, respectively. An internal space of the second leeward header collection pipe is partitioned by a large number of partition plates into n number of second coupling spaces that communicate with the end portions of the n number of flat tubes constructing the leeward tube row, respectively. The n number of first coupling spaces and the n number of second coupling spaces communicate with each other by the n number of coupling pipes, respectively.

CITATION LIST

Patent Literature

Patent Literature 1: Japanese Unexamined Patent Application Publication No. 2015-55413

SUMMARY OF INVENTION

Technical Problem

When the heat exchanger described in Patent Literature 1 is used as an evaporator, refrigerant that is a mixture of gas and liquid flows through each of the first coupling spaces, the coupling pipes, and the second coupling spaces. In this case, the liquid refrigerant having high density stagnates in a space between the flat tube and the partition plate below the flat tube in each of the first coupling spaces and the second coupling spaces. When the liquid refrigerant stagnates, an amount of the refrigerant, which is required to be filled in a refrigeration circuit, is increased. Therefore, there is a problem in that cost of a refrigeration cycle apparatus is increased. Further, refrigerating machine oil having flowed out from a compressor together with the refrigerant also stagnates in the space between the flat tube and the partition plate below the flat tube in each of the first coupling spaces and the second coupling spaces. With this, an amount of the refrigerating machine oil in the compressor is reduced, and the lubricity of a sliding portion of the compressor is degraded. Therefore, there is a problem in that the reliability of the refrigeration cycle apparatus is degraded.

The present invention has been made to solve the problem described above, and has an object to provide a heat exchanger, which is capable of reducing cost of the refrigeration cycle apparatus and enhancing the reliability of the refrigeration cycle apparatus, and a refrigeration cycle apparatus.

Solution to Problem

According to one embodiment of the present invention, there is provided a heat exchanger, including: a first heat exchange unit, which includes a first flat tube configured to allow refrigerant to flow therethrough, and is configured to exchange heat between the refrigerant and air; a second heat exchange unit, which is arranged so as to be opposed to the first heat exchange unit, includes a second flat tube configured to allow the refrigerant to flow therethrough, and is configured to exchange heat between the refrigerant and the air; and a tank, which connects the first heat exchange unit and the second heat exchange unit to each other, in which the tank has an upper wall and a lower wall defining an upper end and a lower end of a tank space formed in the tank, respectively, in which one end of the first flat tube and one end of the second flat tube are connected to the tank space, in which, when a height from the lower wall to the upper wall is defined as X, and a height from the lower wall to the one end of the first flat tube is defined as Y1, a relation between X and Y1 satisfies $Y1<(1/2)X$.

Further, according to one embodiment of the present invention, there is provided a refrigeration cycle apparatus, including the above-mentioned heat exchanger according to one embodiment of the present invention.

Advantageous Effects of Invention

According to the present invention, liquid refrigerant and refrigerating machine oil can be prevented from stagnating in the tank space. Thus, cost of the refrigeration cycle apparatus can be reduced, and the reliability of the refrigeration cycle apparatus can be enhanced.

DESCRIPTION OF EMBODIMENTS

Embodiment 1

A heat exchanger and a refrigeration cycle apparatus according to Embodiment 1 of the present invention are described.

(Configuration of Refrigeration Cycle Apparatus)

Figure 1:
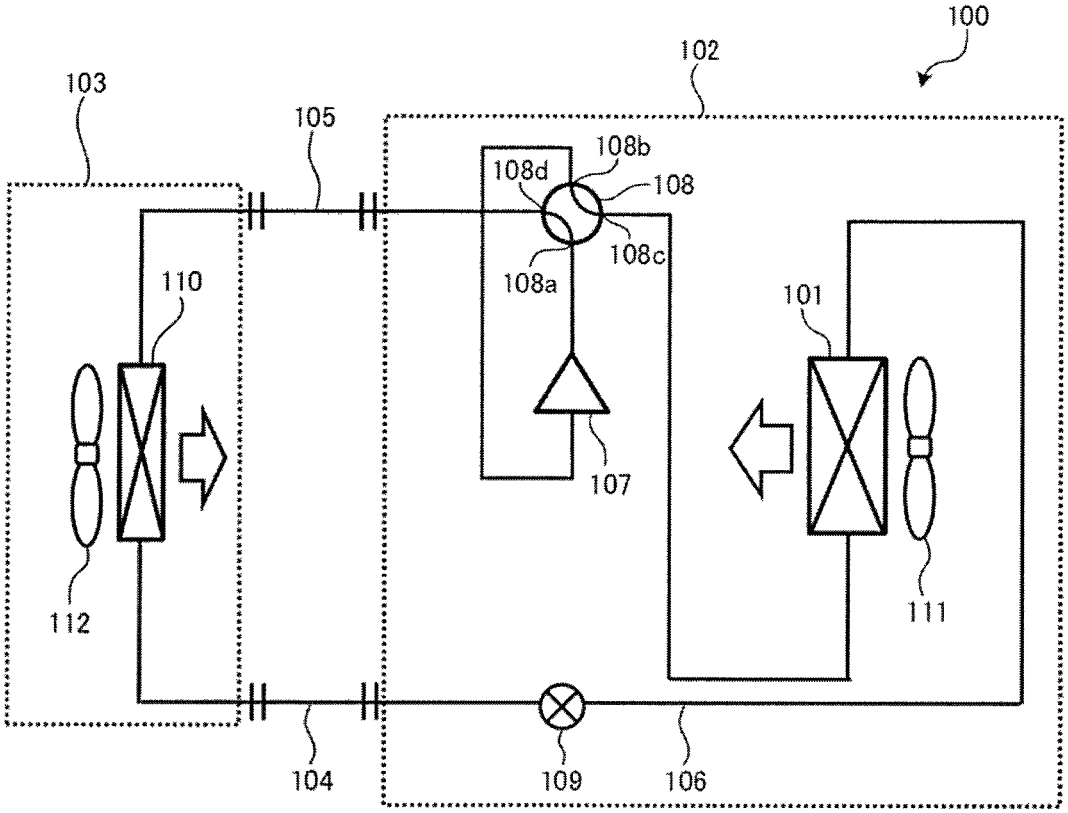
FIG. 1 is a refrigerant circuit diagram for illustrating a configuration of a refrigeration cycle apparatus including a heat exchanger according to Embodiment 1 of the present invention.

FIG. 1 is a refrigerant circuit diagram for illustrating a configuration of a refrigeration cycle apparatus including the heat exchanger according to Embodiment 1. The heat exchanger according to Embodiment 1 is used as, for example, an outdoor heat exchanger 101 of a refrigeration cycle apparatus 100. In the drawings including FIG. 1 referred to below, for example, a relative dimensional relationship of components and shapes of the components may be different from those of actual components. Further, as a rule, an installation posture of each of the components and a positional relationship of the components (for example, a positional relationship of the components in an up-and-down direction) herein are defined assuming that the heat exchanger and the refrigeration cycle apparatus are installed in a usable state.

As illustrated in FIG. 1, the refrigeration cycle apparatus 100 includes an outdoor unit 102 and an indoor unit 103. The outdoor unit 102 is arranged, for example, outdoors, and the indoor unit 103 is arranged, for example, indoors. The outdoor unit 102 and the indoor unit 103 are connected to each other by a liquid-side connection pipe 104 and a gas-side connection pipe 105. Further, the refrigeration cycle apparatus 100 includes a refrigeration circuit 106 constructed by the outdoor unit 102, the indoor unit 103, the liquid-side connection pipe 104, and the gas-side connection pipe 105.

In the refrigeration circuit 106, there are provided a compressor 107, a four-way switching valve 108, the outdoor heat exchanger 101, an expansion valve 109 (an example of a pressure reducing device), and an indoor heat exchanger 110. The compressor 107, the four-way switching valve 108, the outdoor heat exchanger 101, and the expansion valve 109 are accommodated in the outdoor unit 102. In the outdoor unit 102, there is provided an outdoor air-sending fan 111 configured to send outdoor air to the outdoor heat exchanger 101. The indoor heat exchanger 110 is accommodated in the indoor unit 103. In the indoor unit 103, there is provided an indoor air-sending fan 112 configured to send indoor air to the indoor heat exchanger 110.

Next, connection relationships of the components are described. In the refrigeration circuit 106, a discharge pipe of the compressor 107 is connected to a first port 108*a* of the four-way switching valve 108 by a refrigerant pipe. A suction pipe of the compressor 107 is connected to a second port 108*b* of the four-way switching valve 108 by a refrigerant pipe. Further, in the refrigeration circuit 106, the outdoor heat exchanger 101, the expansion valve 109, and the indoor heat exchanger 110 are connected to one another by refrigerant pipes in a part between a third port 108*c* and a fourth port 108*d* of the four-way switching valve 108. The outdoor heat exchanger 101, the expansion valve 109, and the indoor heat exchanger 110 are arranged in the stated order from the third port 108*c* to the fourth port 108*d*.

(Operation of Refrigeration Cycle Apparatus)

Next, an operation of the refrigeration cycle apparatus 100 is described. The refrigeration cycle apparatus 100 can perform a cooling operation and a heating operation by switching flow passages of the four-way switching valve 108.

First, an operation during the heating operation is described. When the heating operation is to be performed, the four-way switching valve 108 is switched as illustrated in FIG. 1. That is, the four-way switching valve 108 is switched so that the first port 108*a* and the fourth port 108*d* communicate with each other, and the second port 108*b* and the third port 108*c* communicated with each other. High-temperature and high-pressure gas refrigerant compressed in the compressor 107 passes through the four-way switching valve 108 and flows into the indoor heat exchanger 110. The indoor heat exchanger 110 operates as a radiator (condenser in this example) during the heating operation. The gas refrigerant having flowed into the indoor heat exchanger 110 is cooled through heat exchange with air sent by the indoor air-sending fan 112 to be condensed. The high-pressure liquid refrigerant condensed in the indoor heat exchanger 110 is reduced in pressure in the expansion valve 109 to be brought into a two-phase gas-liquid state, and flows into the outdoor heat exchanger 101. The outdoor heat exchanger 101 operates as an evaporator during the heating operation. The low-pressure two-phase gas-liquid refrigerant having flowed into the outdoor heat exchanger 101 is heated through heat exchange with air sent by the outdoor air-sending fan 111 to be evaporated. The low-pressure gas refrigerant evaporated in the outdoor heat exchanger 101 passes through the four-way switching valve 108, and is sucked into the compressor 107.

Next, an operation during the cooling operation is described. When the cooling operation is to be performed, the four-way switching valve 108 is switched so that the first port 108*a* and the third port 108*c* communicate with each other, and the second port 108*b* and the fourth port 108*d* communicate with each other. During the cooling operation, the refrigerant in the refrigeration circuit 106 flows in a direction opposite to that during the heating operation, the outdoor heat exchanger 101 operates as a radiator (condenser in this example), and the indoor heat exchanger 110 operates as an evaporator.

(Configuration of Heat Exchanger)

Figure 2:
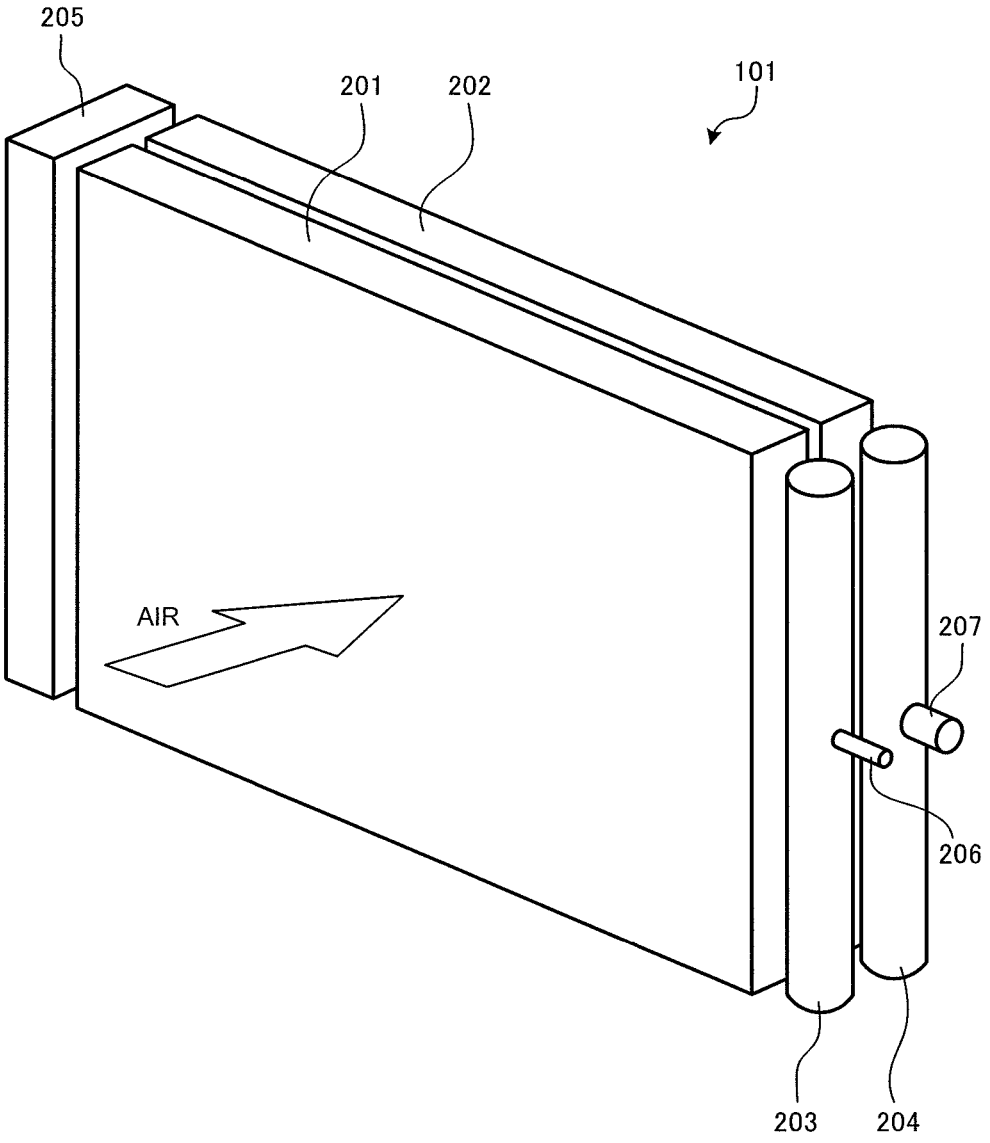
FIG. 2 is a perspective view for illustrating a schematic configuration of the heat exchanger according to Embodiment 1 of the present invention.

FIG. 2 is a perspective view for illustrating a schematic configuration of the heat exchanger according to Embodiment 1. The thick arrow in FIG. 2 indicates a flow direction of the air. As illustrated in FIG. 2, the outdoor heat exchanger 101 has a two-row structure in which two heat exchange units are arranged in series along the flow direction of the air. The outdoor heat exchanger 101 includes a windward-side heat exchange unit 201, a leeward-side heat exchange unit 202, a windward-side header collection pipe 203, a leeward-side header collection pipe 204, and a row-connecting tank 205.

The windward-side heat exchange unit 201 and the leeward-side heat exchange unit 202 are each configured to exchange heat between the refrigerant and the air. The windward-side heat exchange unit 201 and the leeward-side heat exchange unit 202 are arranged so as to be opposed to each other. The windward-side heat exchange unit 201 and the leeward-side heat exchange unit 202 are arranged in series along the flow of the air, and are arranged in series along a flow of the refrigerant. The leeward-side heat exchange unit 202 is arranged on a downstream side with respect to the windward-side heat exchange unit 201 in the flow of the air. Further, the leeward-side heat exchange unit 202 is arranged on a downstream side with respect to the windward-side heat exchange unit 201 in a flow of the refrigerant during the heating operation, and is arranged on an upstream side with respect to the windward-side heat exchange unit 201 in a flow of the refrigerant during the cooling operation.

The windward-side header collection pipe 203 and the leeward-side header collection pipe 204 each have a cylindrical shape extending in the up-and-down direction with both ends being closed. The windward-side header collection pipe 203 is arranged on one end side of the windward-side heat exchange unit 201 in a right-and-left direction. A liquid-side connection pipe 206 is provided on the windward-side header collection pipe 203. The liquid-side connection pipe 206 is configured to allow the two-phase gas-liquid refrigerant to flow into the windward-side header collection pipe 203 from the refrigeration circuit 106 on the expansion valve 109 side during the heating operation. The leeward-side header collection pipe 204 is arranged on one end side of the leeward-side heat exchange unit 202 in the right-and-left direction. A gas-side connection pipe 207 is provided on the leeward-side header collection pipe 204. The gas-side connection pipe 207 is configured to allow the gas refrigerant to flow out from the leeward-side header collection pipe 204 to the refrigeration circuit 106 on the four-way switching valve 108 side during the heating operation.

The row-connecting tank 205 has, for example, a quadrangular cylindrical shape extending in the up-and-down direction with both ends being closed. The row-connecting tank 205 is arranged on another end side of the windward-side heat exchange unit 201 and the leeward-side heat exchange unit 202 in the right-and-left direction, and connects the windward-side heat exchange unit 201 and the leeward-side heat exchange unit 202 to each other. The row-connecting tank 205 is arranged across a windward-side row of the outdoor heat exchanger 101, which is constructed by the windward-side header collection pipe 203 and the windward-side heat exchange unit 201, and a leeward-side row of the outdoor heat exchanger 101, which is constructed by the leeward-side heat exchange unit 202 and the leeward-side header collection pipe 204.

Figure 3:
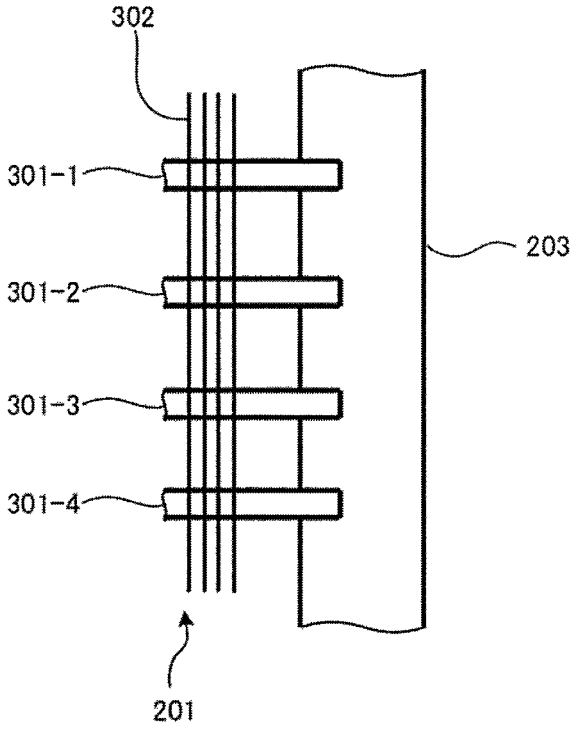
FIG. 3 is a view for illustrating a schematic configuration of a part of a windward-side heat exchange unit 201 and a windward-side header collection pipe 203 of Embodiment 1 of the present invention.

FIG. 3 is a view for illustrating a schematic configuration of a part of the windward-side heat exchange unit 201 and the windward-side header collection pipe 203 in Embodiment 1. As illustrated in FIG. 3, the windward-side heat exchange unit 201 includes a plurality of flat tubes 301. The plurality of flat tubes 301 each extend in a horizontal direction (in the right-and-left direction in FIG. 3), and are arranged in parallel to each other in the up-and-down direction. The number of the flat tubes 301 is n (note that, n is an integer of 2 or more). In FIG. 3, there are illustrated four flat tubes 301-1, 301-2, 301-3, and 301-4 in a case where n number of the flat tubes 301 are defined as flat tubes 301-1 to **301-*n* arranged in the stated order from a top stage. Further, the windward-side heat exchange unit 201 includes a plurality of plate-like fins 302 that cross over with the plurality of respective flat tubes 301. The plurality of plate-like fins 302 are each arranged along the flow direction of the air (direction orthogonal to the drawing sheet of FIG. 3**).

The plurality of respective flat tubes 301 are fixed to the plurality of respective plate-like fins 302 by brazing. One end side of each of the flat tubes 301 in an extending direction thereof is connected to the windward-side header collection pipe 203. Each of the flat tubes 301 is inserted into the windward-side header collection pipe 203, and is fixed to the windward-side header collection pipe 203 by brazing.

Although not illustrated, the leeward-side heat exchange unit 202 and the leeward-side header collection pipe 204 have configurations similar to those of the windward-side heat exchange unit 201 and the windward-side header collection pipe 203. That is, the leeward-side heat exchange unit 202 includes a plurality of flat tubes 401 (see FIG. 4), and the plurality of plate-like fins 302 that cross over with the plurality of respective flat tubes 401. The plurality of flat tubes 401 each extend in the horizontal direction, and are arranged in parallel to each other in the up-and-down direction. The number of the flat tubes 401 in the leeward-side heat exchange unit 202 in this example is n, which is equal to the number of the flat tubes 301 in the windward-side heat exchange unit 201. One end side of each of the flat tubes 401 in an extending direction thereof is connected to the leeward-side header collection pipe 204.

Figure 4:
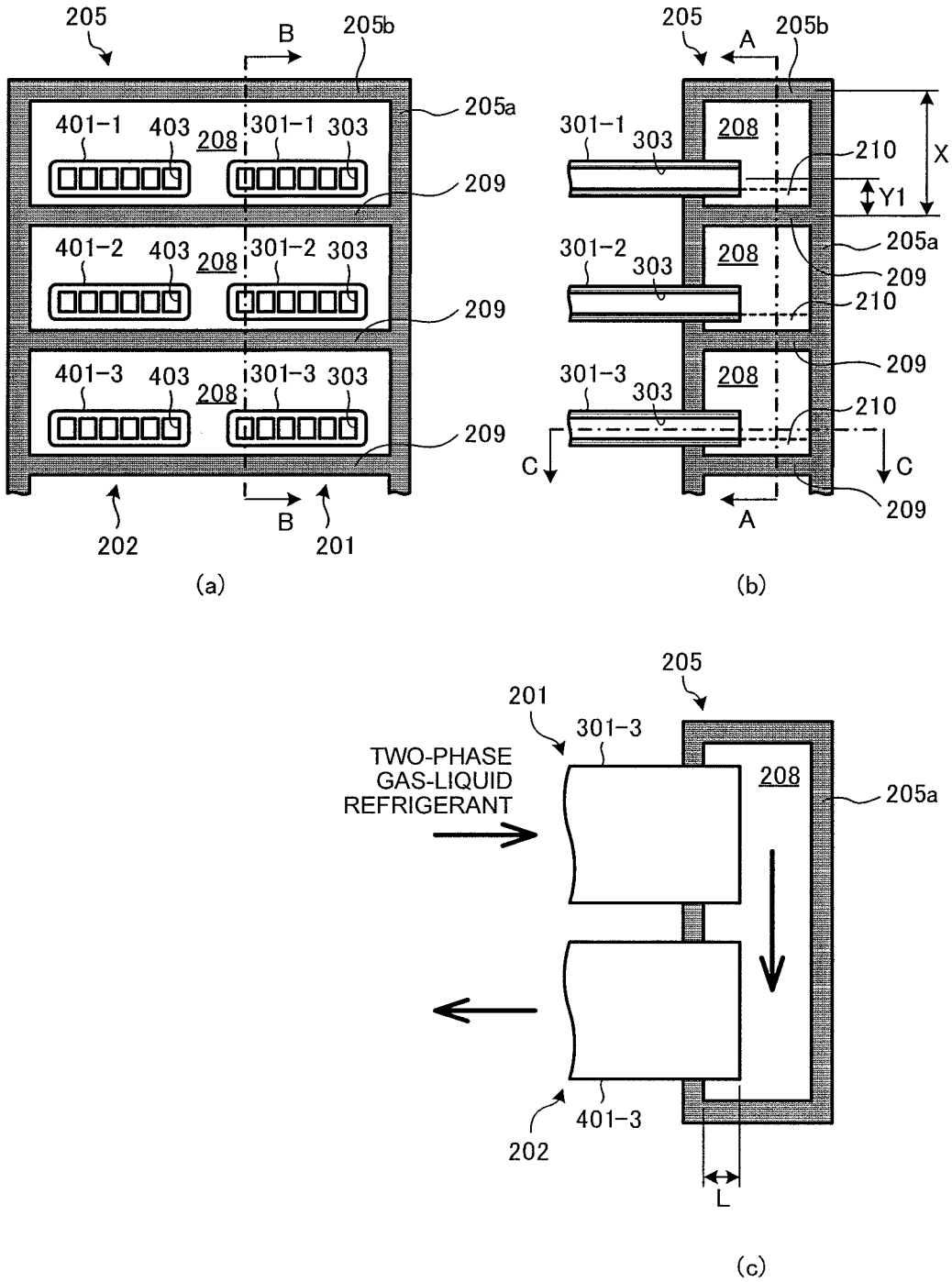
FIG. 4 are each a view for illustrating a configuration of a part of a row-connecting tank 205 in Embodiment 1 of the present invention.

FIG. 4 are each a view for illustrating a configuration of a part of the row-connecting tank 205 in Embodiment 1. In FIG. 4, a configuration of a vicinity of an upper end portion of the row-connecting tank 205 is illustrated. FIG. 4(*a*) is a sectional view taken along the line A-A of FIG. 4(*b*). FIG. 4(*b*) is a sectional view taken along the line B-B of FIG. 4(*a*). FIG. 4(*c*) is a sectional view taken along the line C-C of FIG. 4(*b*). The arrows in FIG. 4(*c*) indicate a flow direction of the two-phase gas-liquid refrigerant during the heating operation. In FIG. 4(*a*), there are illustrated three flat tubes 301-1, 301-2, and 301-3 in a case where n number of the flat tubes 301 are defined as the flat tubes 301-1 to **301-*n* arranged in the stated order from the top stage, and three flat tubes 401-1, 401-2, and 401-3 in a case where n number of the flat tubes 401 are defined as flat tubes 401-1 to 401-*n*** arranged in the stated order from the top stage.

As illustrated in FIG. 4, the row-connecting tank 205 includes a hollow cylindrical portion **205*a* extending in the up-and-down direction, a top wall 205*b* that closes an upper end of the cylindrical portion 205*a*, and a bottom wall (not shown) that closes a lower end of the cylindrical portion 205*a*. An internal space of the row-connecting tank 205 is partitioned by a plurality of partition walls 209 provided horizontally. With this configuration, in the row-connecting tank 205, a plurality of tank spaces 208 arrayed in the up-and-down direction are defined. Each of the tank spaces 208 has, for example, a rectangular parallelepiped shape. In this example, the number of the tank spaces 208 in the row-connecting tank 205 is n, which is equal to the number of the flat tubes 301 and the number of the flat tubes 401**.

An upper end of each of the tank spaces 208 is defined by an upper wall, and a lower end of each of the tank spaces 208 is defined by a lower wall. For example, an upper wall of the tank space 208 located at an uppermost portion in the row-connecting tank 205 corresponds to the top wall **205*b*, and a lower wall of the tank space 208 located at the uppermost portion in the row-connecting tank 205 corresponds to the partition wall 209. An upper wall of the tank space 208 located at a lowermost portion in the row-connecting tank 205 corresponds to the partition wall 209, and a lower wall of the tank space 208 located at the lowermost portion in the row-connecting tank 205 corresponds to the bottom wall of the row-connecting tank 205. All of the upper walls and lower walls of other tank spaces 208 correspond to the partition walls 209**.

The flat tubes 301 each have a shape which is flat in the flow direction of the air (right-and-left direction in FIG. 4(*a*)). The flat tubes 301 are each a multi-hole pipe including a plurality of refrigerant flow passages 303 arrayed in parallel to each other in a flat direction. Similarly, the flat tubes 401 each have a shape which is flat in the flow direction of the air. The flat tubes 401 are each a multi-hole pipe including a plurality of refrigerant flow passages 403 arrayed in parallel to each other in the flat direction.

One end of one flat tube 301 and one end of one flat tube 401 are connected to each of the tank spaces 208. For example, one flat tube 301-1 and one flat tube 401-1 are connected to the tank space 208 located at the uppermost portion in the row-connecting tank 205. With this, n number of the flat tubes 301 and n number of the flat tubes 401 communicate with each other through n number of the tank spaces 208, respectively. The flat tubes 301 and the flat tubes 401 each pass through the cylindrical portion 205*a* and are inserted into the tank space 208 by a length L (see FIG. 4(*c*)). Therefore, a brazing margin for each of the flat tubes 301 and 401 and the row-connecting tank 205 can be secured, and entry of brazing filler metal into each of the refrigerant flow passages 303 and 403 can be prevented. The length L is, for example, 5 mm or more.

In each of the tank spaces 208, the one end of the flat tube 301 and the one end of the flat tube 401 are connected at the same height position, and are arrayed in an array direction in which the windward-side heat exchange unit 201 and the leeward-side heat exchange unit 202 are arrayed (right-and-left direction in FIG. 4(*a*)).

As illustrated in FIG. 4(*b*), a height from the lower wall of the tank space 208 (for example, the wall thickness center of the lower wall) to the upper wall (for example, the wall thickness center of the upper wall) of the tank space 208 is defined as X, and a height from the lower wall of the tank space 208 to the one end of the flat tube 301 (for example, a height to the center axis of the flat tube 301) is defined as Y1. In this case, a relation between X and Y1 satisfies Y1<(½)X. That is, the one end of the flat tube 301 and the one end of the flat tube 401 are arranged on a lower side with respect to the center position of each of the tank spaces 208 in the up-and-down direction.

Figure 5:
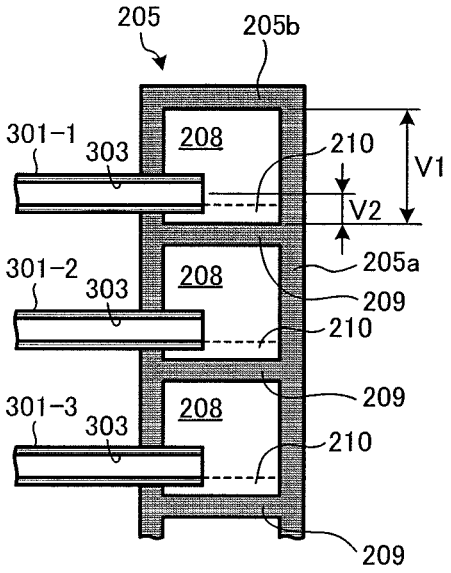
FIG. 5 is a view for illustrating the configuration of a part of the row-connecting tank 205 in Embodiment 1 of the present invention.

The positional relationship of the tank space 208 and each of the flat tubes 301 and 401 as described above may be expressed in another way. FIG. 5 is a view for illustrating a configuration of a part of the row-connecting tank 205 in Embodiment 1, and is an illustration of a cross section which is the same as that of FIG. 4(*b*). As illustrated in FIG. 5, a volume of the tank space 208 is defined as V1, and a volume of the tank space 208 in a range corresponding to a height equal to or lower than the height to the one end of the flat tube 301 (for example, the height to the center axis of the flat tube 301) is defined as V2. In this case, a relation between V1 and V2 satisfies V2<(½)V1.

(Flow of Refrigerant in Heat Exchanger)

Next, a flow of the refrigerant in the outdoor heat exchanger 101 during the heating operation is described. The outdoor heat exchanger 101 operates as an evaporator during the heating operation. The two-phase gas-liquid refrigerant reduced in pressure in the expansion valve 109 in the refrigeration circuit 106 first flows into the windward-side header collection pipe 203 of the outdoor heat exchanger 101 through the liquid-side connection pipe 206. The two-phase gas-liquid refrigerant having flowed into the windward-side header collection pipe 203 is split into the plurality of flat tubes 301 of the windward-side heat exchange unit 201. In the windward-side heat exchange unit 201, the refrigerant flowing through each of the flat tubes 301 is subjected to heat exchange with the air sent by the outdoor air-sending fan 111 to be heated and evaporated. With this, the two-phase gas-liquid refrigerant split into the flat tubes 301 all turn into two-phase gas-liquid refrigerant that has higher quality than at the time when the two-phase gas-liquid refrigerant flows into the windward-side header collection pipe 203, and flow into the plurality of tank spaces 208 of the row-connecting tank 205, respectively. For example, assuming that the quality of the refrigerant at the time of flowing into the windward-side header collection pipe 203 is 0.15, the quality of the refrigerant at the time of flowing into the tank space 208 is about 0.4. That is, the flow of the refrigerant in the tank space 208 is a two-phase gas-liquid flow.

The two-phase gas-liquid refrigerant having flowed into each of the tank spaces 208 flows into each of the flat tubes 401 of the leeward-side heat exchange unit 202. In the leeward-side heat exchange unit 202, the refrigerant flowing through each of the flat tubes 401 is subjected to heat exchange with the air sent by the outdoor air-sending fan 111 to be heated and evaporated. With this, the two-phase gas-liquid refrigerant flowing through the flat tubes 401 all turn into two-phase gas-liquid refrigerant that has further increased quality or gas single-phase refrigerant, and merge at the leeward-side header collection pipe 204. The refrigerant having merged at the leeward-side header collection pipe 204 flows out to the four-way switching valve 108 side of the refrigeration circuit 106 through the gas-side connection pipe 207, and is sucked into the compressor 107.

Next, a state of the refrigerant in the tank space 208 is described. As described above, the flow of the refrigerant in the tank space 208 is a two-phase gas-liquid flow. Therefore, liquid refrigerant having relatively high density may stagnate in a dead space 210 in the tank space 208 under the effect of gravity. In FIG. 4(*b*) and FIG. 5, the dead space 210 is illustrated by dot hatching. The dead space 210 is a space in the tank space 208, which is located on a lower side with respect to each of the refrigerant flow passages 303 and 403 of the flat tubes 301 and 401. Further, similarly to the liquid refrigerant, refrigerating machine oil having flowed out from the compressor 107 together with the gas refrigerant may also stagnate in the dead space 210.

Effect of Embodiment 1

As described above, the heat exchanger according to Embodiment 1 includes the windward-side heat exchange unit 201, the leeward-side heat exchange unit 202, and the row-connecting tank 205. The windward-side heat exchange unit 201 includes the flat tubes 301 configured to allow the refrigerant to flow therethrough, and is configured to exchange heat between the refrigerant and the air. The leeward-side heat exchange unit 202 is arranged so as to be opposed to the windward-side heat exchange unit 201, includes the flat tubes 401 configured to allow the refrigerant to flow therethrough, and is configured to exchange heat between the refrigerant and the air. The row-connecting tank 205 connects the windward-side heat exchange unit 201 and the leeward-side heat exchange unit 202 to each other. The row-connecting tank 205 has the upper walls (for example, the top wall 205*b* and the partition walls 209) each defining the upper end of the tank space 208, and the lower walls (for example, the partition walls 209 and the bottom wall of the row-connecting tank 205) each defining the lower end of the tank space 208. The one end of the flat tube 301 and the one end of the flat tube 401 are connected to the tank space 208. In the tank space 208, the one end of the flat tube 301 and the one end of the flat tube 401 are arranged at the same height position. When the height from the lower wall to the upper wall is defined as X, and the height from the lower wall to the one end of the flat tube 301 is defined as Y1, a relation between X and Y1 satisfies Y1<(½)X.

Further, in the heat exchanger according to Embodiment 1, when the volume of the tank space 208 is defined as V1, and the volume of the tank space 208 in the range corresponding to the height equal to or lower than the height to the one end of the flat tube 301 is defined as V2, V1 and V2 may be set so that a relation therebetween satisfies V2<(½) V1. Further, in the heat exchanger according to Embodiment 1, the number of the flat tubes 301 and the number of the flat tubes 401 connected to one tank space 208 may be one.

Further, the refrigeration cycle apparatus according to Embodiment 1 includes the heat exchanger according to Embodiment 1.

According to the configuration of Embodiment 1, the one end of the flat tube 301 and the one end of the flat tube 401 connected to the tank space 208 are arranged on the lower side with respect to the center position of the tank space 208 in the up-and-down direction. With this, the volume of the dead space 210 formed in the lower portion in the tank space 208 can be reduced. Therefore, an amount of the liquid refrigerant and the refrigerating machine oil that stagnate in the tank space 208 can be reduced. Thus, according to Embodiment 1, the amount of the refrigerant filled in the refrigeration circuit 106 can be reduced. Therefore, cost of the refrigeration cycle apparatus 100 can be reduced. Further, according to Embodiment 1, the amount of the refrigerant filled in the refrigeration circuit 106 can be reduced. Therefore, even when the refrigerant leaks, for example, through the refrigerant pipe, the amount of the refrigerant released to the atmosphere can be reduced. Thus, an environmental burden of the refrigeration cycle apparatus 100 can be reduced.

Further, according to Embodiment 1, depletion of the refrigerating machine oil in the compressor 107 can be prevented. Therefore, the lubricity of a sliding portion of the compressor 107 can be maintained. Thus, the reliability of the refrigeration cycle apparatus 100 can be enhanced.

In Embodiment 1, with the configuration in which the relation between the height X from the lower wall to the upper wall of the tank space 208 and the height Y1 from the lower wall to the one end of the flat tube 301 satisfies Y1<(½)X, the volume of the dead space 210 in the tank space 208 is reduced. However, the present invention is not limited to the configuration of Embodiment 1 as long as the volume of the dead space 210 in the tank space 208 can be reduced.

Embodiment 2

Figure 6:
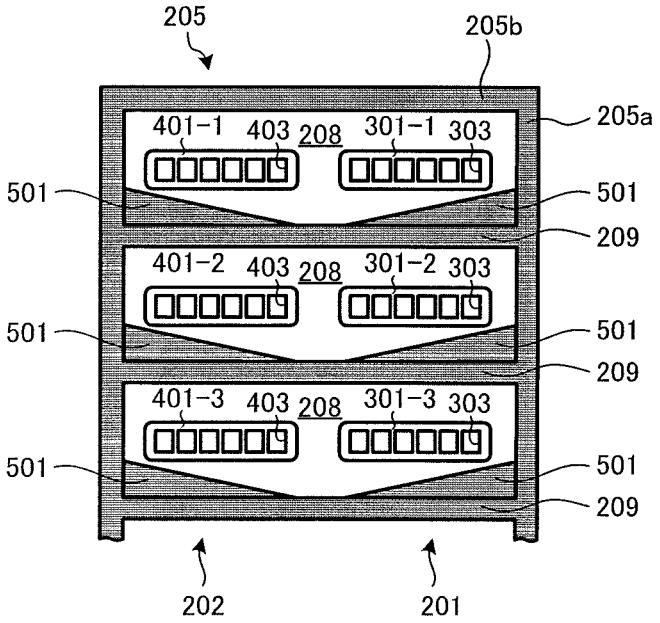
FIG. 6 is a view for illustrating a configuration of a part of the row-connecting tank 205 in Embodiment 2 of the present invention.

The heat exchanger according to Embodiment 2 of the present invention is described. FIG. 6 is a view for illustrating a configuration of a part of the row-connecting tank 205 in Embodiment 2. In FIG. 6, a cross section of the row-connecting tank 205, which corresponds to FIG. 4(*a*), is illustrated. Components having the same functions and same effects as those of Embodiment 1 are denoted by the same reference symbols, and description thereof is omitted.

As illustrated in FIG. 6, the one end of the one flat tube 301 and the one end of the one flat tube 401 are connected to each of the tank spaces 208. For example, the one flat tube 301-1 and the one flat tube 401-1 are connected to the tank space 208 located at the uppermost portion in the row-connecting tank 205. With this, n number of the flat tubes 301 and n number of the flat tubes 401 communicate with each other through n number of the tank spaces 208, respectively. Similarly to Embodiment 1, the flat tubes 301 and the flat tubes 401 each pass through the cylindrical portion 205*a* and are inserted into the tank space 208 by the length L (for example, 5 mm or more).

The lower wall of each of the tank spaces 208 (for example, the partition wall 209 or the bottom wall of the row-connecting tank 205) in Embodiment 2 includes thick portions 501 at which the height of the bottom surface of the tank space 208 is partially increased. In this example, the two tapered thick portions 501 each having a flat inclined surface are arranged on both end portions in the array direction (right-and-left direction in FIG. 6). With this, the inclined surfaces of the two thick portions 501 construct a part of the bottom surface of the tank space 208. Therefore, the height of the bottom surface of the tank space 208 is increased toward both the end portions in the array direction. The inclined surfaces of the thick portions 501 may be curved instead of being flat. Further, the thick portions 501 may be formed separately from the lower wall of the tank space 208, or may be formed integrally with the lower wall of the tank space 208.

In Embodiment 2, similarly to Embodiment 1 described above, the flat tubes 301 and 401 connected to the tank space 208 in the up-and-down direction may be each arranged at a portion on the lower side with respect to the center of the tank space 208 in the up-and-down direction, at the center of the tank space 208 in the up-and-down direction, or on an upper side with respect to the center of the tank space 208 in the up-and-down direction.

As described above, in the heat exchanger according to Embodiment 2, the lower wall of the tank space 208 (for example, the partition wall 209 or the bottom wall of the row-connecting tank 205) includes the thick portions 501 at which the height of the bottom surface of the tank space 208 is partially increased.

According to the above-mentioned configuration, the volume of the dead space 210 formed in the lower portion in the tank space 208 can be reduced. Therefore, the amount of the liquid refrigerant and the refrigerating machine oil that stagnate in the tank space 208 can be reduced. With this, the amount of the refrigerant filled in the refrigeration circuit 106 can be reduced. Therefore, according to Embodiment 2, cost of the refrigeration cycle apparatus 100 can be reduced. Further, the amount of the refrigerant filled in the refrigeration circuit 106 can be reduced. Therefore, even when the refrigerant leaks, for example, through the refrigerant pipe, the amount of the refrigerant released to the atmosphere can be reduced. Thus, according to Embodiment 2, the environmental burden of the refrigeration cycle apparatus 100 can be reduced.

Further, the depletion of the refrigerating machine oil in the compressor 107 can be prevented. Therefore, the lubricity of the sliding portion of the compressor 107 can be maintained. Thus, according to Embodiment 2, the reliability of the refrigeration cycle apparatus 100 can be enhanced.

Embodiment 3

Figure 7:
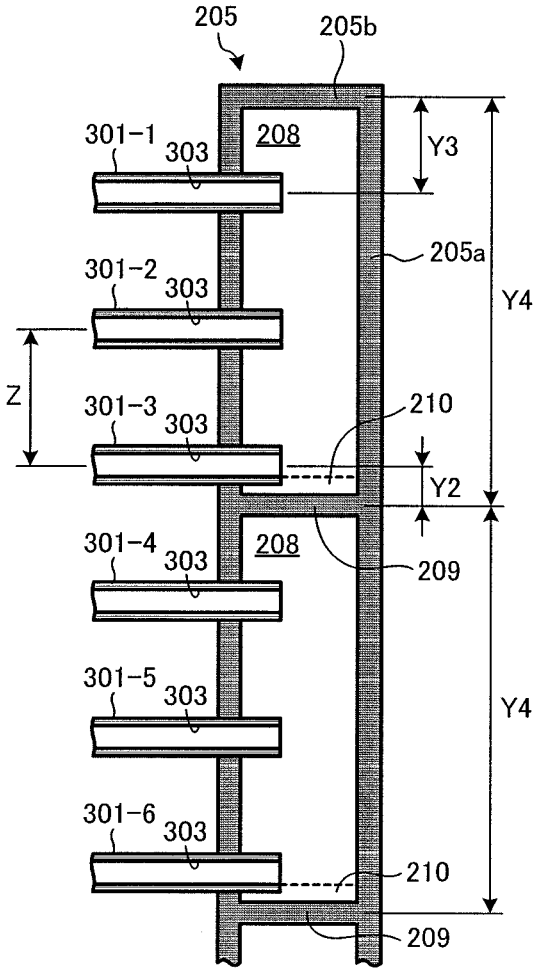
FIG. 7 is a view for illustrating a configuration of a part of the row-connecting tank 205 in Embodiment 3 of the present invention.

The heat exchanger according to Embodiment 3 of the present invention is described. FIG. 7 is a view for illustrating a configuration of a part of the row-connecting tank 205 in Embodiment 3. In FIG. 7, a cross section of the row-connecting tank 205, which corresponds to FIG. 4(*b*), is illustrated. Further, in FIG. 7, six flat tubes 301-1, 301-2, 301-3, 301-4, 301-5, and 301-6 in a case where n number of the flat tubes 301 are defined as the flat tubes 301-1 to 301-*n* arranged in the stated order from the top stage are illustrated. Components having the same functions and same effects as those of Embodiment 1 are denoted by the same reference symbols, and description thereof is omitted.

As illustrated in FIG. 7, one end of each of the plurality of the flat tubes 301 and one end of each of the plurality of the flat tubes 401 (not shown in FIG. 7) are connected to the tank space 208 in Embodiment 3. For example, the three flat tubes 301-1, 301-2, and 301-3 and three flat tubes 401-1, 401-2, and 401-3 are connected to the tank space 208 located at the uppermost portion in the row-connecting tank 205. In the tank space 208, the one end of each of the flat tubes 301-1, 301-2, and 301-3 and the one end of each of the flat tubes 401-1, 401-2, and 401-3 are arranged at the same height position. Three flat tubes 301-4, 301-5, and 301-6 and three flat tubes 401-4, 401-5, and 401-6 are connected to the tank space 208 at the second stage from the top. In the tank space 208, one end of each of the flat tubes 301-4, 301-5, and 301-6 and one end of each of the flat tubes 401-4, 401-5, and 401-6 are arranged at the same height position.

A height from the lower wall of the tank space 208 (for example, the wall thickness center of the lower wall) to one end of the flat tube at a lowermost stage (for example, the flat tube 301-3) among the flat tubes 301 connected to the tank space 208 (for example, a height to the center axis of the flat tube 301-3) is defined as Y2. Further, an array pitch of the flat tubes 301 in the up-and-down direction is defined as Z. In this case, a relation between Y2 and Z satisfies $Y2<(1/2)Z$.

Further, a height from one end of the flat tube at an uppermost stage (for example, the flat tube 301-1) among the flat tubes 301 connected to the tank space 208 to the upper wall of the tank space 208 (for example, the wall thickness center of the upper wall) is defined as Y3. In this case, a relation between Y2 and Y3 satisfies $Y2<Y3$. Further, for example, a relation of Y2, Y3 and Z satisfies $Y2+Y3=Z$.

Further, a height from the lower wall of the tank space 208 (for example, the wall thickness center of the lower wall) to the upper wall of the tank space 208 (for example, the wall thickness center of the upper wall) is defined as Y4. In this case, the value of Y4 is equal in each of the plurality of tank spaces 208.

As described above, in the heat exchanger according to Embodiment 3, the one end of each of the plurality of the flat tubes 301 arrayed in the up-and-down direction and the one end of each of the plurality of flat tubes 401 arrayed in the up-and-down direction are connected to the tank space 208. The number of the flat tubes 301 and the number of the flat tubes 401 connected to the tank space 208 are equal. The one end of each of the plurality of the flat tubes 301 and the one end of each of the plurality of the flat tubes 401 are connected at the same height position in the tank space 208. When the height from the lower wall of the tank space 208 (for example, the partition wall 209 or the bottom wall of the row-connecting tank 205) to the one end of the flat tube 301-3 at the lowermost stage among the plurality of flat tubes 301-1, 301-2, and 301-3 connected to the tank space 208 is defined as Y2, and the array pitch of the plurality of flat tubes 301 in the up-and-down direction is defined as Z, a relation between Y2 and Z may satisfy $Y2<(1/2)Z$.

According to the above-mentioned configuration, the volume of the dead space 210 formed in the lower portion in the tank space 208 can be reduced. Therefore, the amount of the liquid refrigerant and the refrigerating machine oil that stagnate in the tank space 208 can be reduced. Thus, according to Embodiment 3, the amount of the refrigerant filled in the refrigeration circuit 106 can be reduced. Therefore, cost of the refrigeration cycle apparatus 100 can be reduced. Further, according to Embodiment 3, the amount of the refrigerant filled in the refrigeration circuit 106 can be reduced. Therefore, even when the refrigerant leaks, for example, through the refrigerant pipe, the amount of the refrigerant released to the atmosphere can be reduced. Thus, the environmental burden of the refrigeration cycle apparatus 100 can be reduced.

Further, according to Embodiment 3, the depletion of the refrigerating machine oil in the compressor 107 can be prevented. Therefore, the lubricity of the sliding portion of the compressor 107 can be maintained. Thus, the reliability of the refrigeration cycle apparatus 100 can be enhanced.

Further, the heat exchanger according to Embodiment 3, when the height from the one end of the flat tube 301-1 at the uppermost stage among the plurality of flat tubes 301 connected to the tank space 208 to the upper wall of the tank space 208 (for example, the top wall 205*b* or the partition wall 209) is defined as Y3, a relation between Y2 and Y3 may satisfy $Y2<Y3$.

According to the above-mentioned configuration, the height Y4 of each of the plurality of tank spaces 208 can be set equal. Therefore, the row-connecting tank 205 can be manufactured using common components. Thus, the productivity of the heat exchanger can be enhanced.

Embodiment 4

Figure 8:
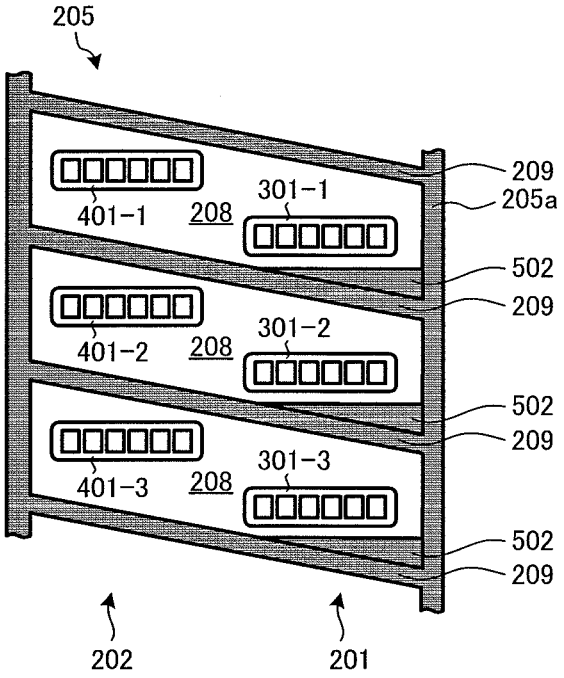
FIG. 8 is a view for illustrating a configuration a part of the row-connecting tank 205 in Embodiment 4 of the present invention.

The heat exchanger according to Embodiment 4 of the present invention is described. FIG. 8 is a view for illustrating a configuration of a part of the row-connecting tank 205 in Embodiment 4. In FIG. 8, a cross-section of the row-connecting tank 205, which corresponds to FIG. 4(*a*), is illustrated. Components having the same functions and same effects as those of Embodiment 1 are denoted by the same reference symbols, and description thereof is omitted.

As illustrated in FIG. 8, an array of the flat tubes 301 in the up-and-down direction and an array of the flat tubes 401 in the up-and-down direction are shifted from each other by a half pitch. With this, the flat tubes 301 and 401 are arranged in a staggered pattern.

The one end of the one flat tube 301 and the one end of the one flat tube 401 are connected to each of the tank spaces 208. For example, the one flat tube 301-1 and the one flat tube 401-1 are connected to the tank space 208 located at the uppermost portion in the row-connecting tank 205. In the tank space 208, the height of the one end of the flat tube 301-1 is lower than the height of the one end of the flat tube 401-1 by a half pitch.

A part of the bottom surface of the tank space 208 is inclined in one direction in accordance with the difference in height between the flat tubes 301 and 401. The lower wall of each of the tank spaces 208 (for example, the partition wall 209 or the bottom wall of the row-connecting tank 205) may include a thick portion 502 that is horizontal or has a round shape at a portion having the lowest height in the bottom surface of the tank space 208 (for example, a portion below the flat tube 301). With this, the portion having the lowest height in the bottom surface of the tank space 208 is formed to be horizontal or into a round shape. The thick portion 502 may be formed separately from the lower wall of the tank space 208, or may be formed integrally with the lower wall of the tank space 208.

As described above, the heat exchanger according to Embodiment 4 includes the windward-side heat exchange unit 201, the leeward-side heat exchange unit 202, and the row-connecting tank 205. The windward-side heat exchange unit 201 includes the flat tubes 301 configured to allow the refrigerant to flow therethrough, and is configured to exchange heat between the refrigerant and the air. The leeward-side heat exchange unit 202 is arranged so as to be opposed to the windward-side heat exchange unit 201, includes the flat tubes 401 configured to allow the refrigerant to flow therethrough, and is configured to exchange heat between the refrigerant and the air. The row-connecting tank 205 connects the windward-side heat exchange unit 201 and the leeward-side heat exchange unit 202 to each other. The row-connecting tank 205 includes the lower walls (for example, the partition walls 209 and the bottom wall of the row-connecting tank 205) each defining the lower end of the tank space 208. The one end of the flat tube 301 and the one end of the flat tube 401 are connected to the tank space 208. The one end of the flat tube 301 and the one end of the flat tube 401 are connected at the different height positions in the tank space 208. A part of the bottom surface of the tank space 208 is inclined. The portion having the lowest height in the bottom surface of the tank space 208 is formed to be horizontal.

According to the configuration, the volume of the dead space 210 formed in the lower portion in the tank space 208 can be reduced. Therefore, the amount of the liquid refrigerant and the refrigerating machine oil that stagnate in the tank space 208 can be reduced. With this, the amount of the refrigerant filled in the refrigeration circuit 106 can be reduced. Therefore, according to Embodiment 4, cost of the refrigeration cycle apparatus 100 can be reduced. Further, the amount of the refrigerant filled in the refrigeration circuit 106 can be reduced. Therefore, even when the refrigerant leaks, for example, through the refrigerant pipe, the amount of the refrigerant released to the atmosphere can be reduced. Thus, according to Embodiment 4, the environmental burden of the refrigeration cycle apparatus 100 can be reduced.

Further, the depletion of the refrigerating machine oil in the compressor 107 can be prevented. Therefore, the lubricity of the sliding portion of the compressor 107 can be maintained. Thus, according to Embodiment 4, the reliability of the refrigeration cycle apparatus 100 can be enhanced.

Other Embodiments

The present invention is not limited to the above-mentioned embodiments, and various modifications may be made thereto.

For example, in the above-mentioned embodiments, the heat exchanger having a two-row structure is given as an example. However, the present invention is also applicable to a heat exchanger having a multi-row structure with three or more rows.

Further, in the above-mentioned embodiments, the outdoor heat exchanger 101 is given as an example. However, the heat exchanger of the present invention is also applicable to the indoor heat exchanger 110.

REFERENCE SIGNS LIST

100 refrigeration cycle apparatus 101 outdoor heat exchanger 102 outdoor unit 103 indoor unit 104 liquid-side connection pipe 105 gas-side connection pipe 106 refrigeration circuit 107 compressor 108 four-way switching valve 108*a* first port 108*b* second port 108*c* third port 108*d* fourth port 109 expansion valve 110 indoor heat exchanger 111 outdoor air-sending fan 112 indoor air-sending fan 201 windward-side heat exchange unit 202 leeward-side heat exchange unit 203 windward-side header collection pipe 204 leeward-side header collection pipe 205 row-connecting tank 205*a* cylindrical portion 205*b* top wall 206 liquid-side connection pipe 207 gas-side connection pipe 208 tank space 209 partition wall 210 dead space 301, 301-1, 301-2, 301-3, 301-4, 301-5, 301-6 flat tube 302 plate-like fin 303 refrigerant flow passage 401, 401-1, 401-2, 401-3, 401-4, 401-5, 401-6 flat tube 403 refrigerant flow passage 501, 502 thick portion

The invention claimed is:

1. A two-pass heat exchanger, having:

first and second sets of flat tubes defining first and second units for internal fluid; and a tank connecting the first unit and second unit at distal ends of the flat tubes of the first and second units, wherein the tank has plural spaced connection chambers, each defined in part by spaced transverse walls that extend parallel to the flat tubes, arrayed along a direction perpendicular to the flat tubes, each connection chamber has a single flat tube from the first unit and a single flat tube from the second unit connected to the tank, and the flat tubes are connected to the tank at locations relative to the spaced transverse walls defining a respective connection chamber such that the distal ends of the flat tubes lie substantially closer to a first of the transverse walls defining the respective connection chamber than to a second of the transverse walls defining the respective connection chamber.

2. The two pass heat exchanger of claim 1, wherein, when a volume of the connection chamber is defined as V1, and a volume in the connection chamber in a range corresponding to a height equal to or lower than the height to the distal end of the flat tube is defined as V2, a relation between V1 and V2 satisfies $V2<(1/2)V1$.

3. The two pass heat exchanger of claim 1, wherein the one of the transverse walls defining the respective connection chamber includes a thick portion at which a height of a bottom surface of the connection chamber is partially increased.

4. A refrigeration cycle apparatus, comprising the two pass heat exchanger of claim 1.

* * * * *